US005587022A

United States Patent [19]

Black

[11] Patent Number: 5,587,022

[45] Date of Patent: Dec. 24, 1996

[54] METHOD OF RINSING SHOWERS

[76] Inventor: Robert H. Black, 4858 Mariner Point, Jacksonville, Fla. 32225

[21] Appl. No.: 439,382

[22] Filed: May 11, 1995

Related U.S. Application Data

[60] Division of Ser. No. 374,918, Jan. 19, 1995, abandoned, which is a continuation-in-part of Ser. No. 162,751, Dec. 7, 1993, abandoned.

[51] Int. Cl.[6] ..... B08B 3/04; B08B 3/08

[52] U.S. Cl. ..... 134/26; 134/28; 134/29; 134/42

[58] Field of Search ..... 134/2, 3, 26, 29, 134/28, 42; 252/546, 174.21, 544, DIG. 1, DIG. 10, DIG. 11

[56] References Cited

U.S. PATENT DOCUMENTS

| | | | |
|---|---|---|---|
| 3,553,143 | 1/1971 | Bauer | 252/152 |
| 3,694,365 | 9/1972 | Castner | 252/106 |
| 3,756,950 | 9/1973 | Gluck | 252/8.75 |
| 3,882,038 | 5/1975 | Clayton et al. | 252/164 |
| 3,914,185 | 10/1975 | Inamorato | 252/546 |
| 3,970,595 | 7/1976 | Ginn et al. | 252/545 |
| 3,980,587 | 9/1976 | Sullivan | 252/546 |
| 4,020,016 | 4/1977 | Sokol | 252/546 |
| 4,028,261 | 6/1977 | Petersen et al. | 252/89 R |
| 4,048,121 | 9/1977 | Chang | 252/527 |
| 4,284,435 | 8/1981 | Fox | 134/2 |
| 4,302,348 | 11/1981 | Requejo | 252/135 |
| 4,343,725 | 8/1982 | Kiewert et al. | 252/542 |
| 4,395,365 | 7/1983 | Itasegawa et al. | 252/545 |
| 4,443,270 | 4/1984 | Biard et al. | 134/25.2 |
| 4,530,781 | 7/1985 | Gipp | 252/546 |
| 4,597,888 | 7/1986 | King | 252/135 |
| 4,678,596 | 7/1987 | Dupre et al. | 252/174.24 |
| 4,749,516 | 6/1988 | Brusky | 252/546 |
| 4,863,629 | 9/1989 | Osberghaus et al. | 252/162 |
| 5,061,393 | 10/1991 | Linares et al. | 252/143 |
| 5,075,040 | 12/1991 | Rivenaes | 252/548 |
| 5,232,632 | 8/1993 | Woo et al. | 252/546 |
| 5,252,245 | 10/1993 | Garabedian, Jr. et al. | 252/153 |
| 5,342,537 | 8/1994 | Conville et al. | 252/174.24 |

FOREIGN PATENT DOCUMENTS

| | | |
|---|---|---|
| 2115833 | 11/1985 | Japan . |
| 3165497 | 12/1986 | Japan . |
| 3193998 | 7/1987 | Japan . |

*Primary Examiner*—Zeinab El-Arini
*Attorney, Agent, or Firm*—Browdy and Neimark

[57] ABSTRACT

A method of removing deposits from surfaces of showers and the like without scrubbing or wiping by using a composition that includes a non-ionic surfactant having an HLB of 13 or less, a chelating agent, and optionally, alcohol and/or ammonium hydroxide and/or morpholine.

20 Claims, No Drawings

METHOD OF RINSING SHOWERS

BACKGROUND OF TH INVENTION

This is a division of application Ser. No. 08/374,918 filed Jan. 19, 1995 now abandoned, itself a continuation-in-part of application Ser. No. 08/162,751 filed Dec. 7, 1993, now abandoned.

FIELD OF THE INVENTION

The invention relates to a rinsing solution composition for keeping showers and the like clean, and a method of using same.

DESCRIPTION OF THE RELATED ART

Shower stalls and tubs accumulate a steady build-up of organic and inorganic deposits on their surfaces as a result of repeated use. The accumulation of such deposits, which include insoluble soap curds, washed-off debris from the body partially coated with soap or shampoo, calcium carbonate, other insoluble metal salts, and growth of mildew and microorganisms, creates an unsightly and unhealthy environment that is unacceptable from the standpoint of cleanliness and good hygiene, as well as aesthetics.

Conventionally, the build-up of deposits in a shower can be cleaned with any of a number of aggressive cleaners commercially available to the consumer. These cleaners, which contain combinations of surfactants, chelating agents, oxidizers, abrasives, and soluble salts, require repeated scrubbing or wiping with the cleaner, followed generally with a water rinse, to periodically remove the unsightly and unhealthy build-up in the shower. Considerable labor is required to maintain a clean shower using these conventional cleaners.

Sokol, U.S. Pat. No. 4,020,016, discloses aqueous cleaning compositions for dissolving soap curds that require a non-ionic surfactant having an HLB (hydrophilic-lipophilic balance) number of at least 13.5. There is no disclosure of how the aqueous cleaning compositions are used.

At the present time, there is no acceptable product for maintaining shower surfaces clean without the action of scrubbing or wiping-off of surface deposits.

SUMMARY OF THE INVENTION

It is, accordingly, an object of the present invention to overcome the deficiencies in the prior art, such as noted above.

Another object of the invention is to provide a composition for a shower rinsing solution for cleaning showers and keeping them clean.

A further object of the invention is to provide a method of using the shower rinsing composition to maintain a clean shower and prevent the build-up of undesirable deposits on shower surfaces.

The present invention relates to an easy and safe-to-use, non-streaking aqueous composition, which includes a non-ionic surfactant having a hydrophilic-lipophilic balance number (HLB) of 13.0 or less, a chelating agent, and optionally, alcohol and/or ammonium hydroxide and/or morpholine, for rinsing shower surfaces free from deposits, and without the necessity of wiping or scrubbing.

The present invention also relates to a method of using the liquid shower rinsing composition to maintain a clean shower without scrubbing or wiping of the shower surfaces.

DETAILED DESCRIPTION OF THE EMBODIMENTS

The aqueous shower rinsing composition of the invention includes a non-ionic surfactant having an HLB of 13 or less, a chelating agent, and optionally, an alcohol and/or ammonium hydroxide and/or morpholine.

In accordance with the invention, a preferred embodiment of the aqueous shower rinsing solution has the following composition expressed in percent (%) by volume:

| | |
|---|---|
| isopropyl alcohol | 4.4% |
| ANTAROX BL-225 surfactant | 1.5% |
| Hamp-ene diammonium EDTA 44% solution | 1.5% |
| fragrance | 0.002% |
| water | balance |

The non-ionic surfactant used in the present invention advantageously removes both cationic and anionic surfactant residues and deposits and is preferably a liquid at ambient temperatures. This non-ionic surfactant also preferably has an HLB (hydrophilic-lipophilic balance number) of 13.0 or less, more preferably 12.5 or less, and most preferably about 12 or less, to avoid leaving streaks on shower surfaces. In general, the aqueous shower rinsing composition contains a non-ionic surfactant in the range of about 0.5 to 3% by volume, more preferably 1 to 2% by volume, most preferably about 1.5% by volume.

ANTAROX BL-225 (Rhone-Poulenc, Cranbury, N. J.), a mixed ethylene glycol ether (modified linear aliphatic polyether) with an HLB of 12 and a cloud point of 27° C., is the preferred non-ionic surfactant. Non-ionic surfactants, such as alkylphenol glycol ethers, sorbitan oleic ester, silicone polyalkoxylate block copolymers, mixtures thereof, and mixtures in combination with ANTAROX BL-225, having an HLB of 13 or less are non-limiting examples of other suitable non-ionic surfactants.

Non-ionic surfactants are also characterized by the cloud point. Excess surfactant, exceeding the solubility limit in water, forms a dispersion and exists in micelles below the cloud point. When the temperature is increased above the cloud point, the excess surfactant separates into a second phase. It will be appreciated that the HLB can be calculated or readily estimated from the cloud point. The determination of both HLB and the cloud point of non-ionic surfactants are well within the knowledge and skill of ordinary artisans.

Preferably, the chelating agent is diammonium ethylene diamine tetraacetate (diammonium EDTA), such as the Hamp-ene diammonium EDTA (manufactured by Hampshire Chemical Corporation, Lexington, Mass.), which is a 44% aqueous solution of the diammonium salt of EDTA. This commercially available 44% solution is easy to mix, economical in cost, and has low toxicity. Other chelating agents, such as, but not limited to, ethylene diamine tetraacetic acid (EDTA), hydroxyethyl ethylene diaminetriacetic acid (HEEDTA), diethylenetriamine pentaacetic acid (DTPA), and nitrilotriacetic acid (NTA), can be substituted for diammonium EDTA on an equivalent chelating strength basis.

A 44% solution of diammonium EDTA is preferably mixed in the aqueous shower rinsing composition in an amount of about 0.2 to 2.0% by volume. On an equivalent chelating strength basis, the other chelating agents mentioned above, as well as a solution of diammonium EDTA of different concentration, can be mixed in the aqueous shower rinsing composition in an amount of about 0.1 to 3% by volume.

Ammonium hydroxide or morpholine can be used to increase the pH of the aqueous shower rinsing solution depending on the acidity of the chelating agent. The pH of the aqueous shower rinsing solution is preferably in the range of about pH 4 to 8, more preferably in the range of about pH 5 to 7.

An alcohol, which increase the solvent properties and improves the sheeting action by keeping the viscosity low in order to minimize any residual film on shower surfaces, can optionally be added to the aqueous shower rinsing solution in the range of about 1 to 8% by volume. Any short-chain alcohol, such as ethyl alcohol, isopropyl alcohol, n-propyl alcohol, n-butyl alcohol, and isobutyl alcohol, can be used, although isopropyl alcohol is preferred. Ethylene glycol, propylene glycol, glycerol, the isopropyl ether of ethylene glycol, or the ethyl ether of ethylene glycol can be used as possible substitutes for a short-chain alcohol. Methyl alcohol, however, is not recommended due to its toxicity and also to its property of being too volatile.

The aqueous shower rinsing solution preferably contains fragrance to provide a fresh and clean smell. Although the addition of fragrance is optional, it satisfies the expectation of consumers that a clean shower would smell "fresh and clean". However, a composition which lacks a fragrance additive still performs satisfactorily in cleaning the shower surfaces according to the criteria discussed below in Example 1.

Pine odor #82555 and Fresh and Clean odor #82556 (AFF, Marietta, Ga.) are commercially available and both are equally acceptable as the preferred fragrance. However, any of a number of commercially available fragrances or odor additives may be used to provide a fresh and clean smell and is well within the skill of those in the art. Generally, 0.0005% to 0.008% of fragrance additive is mixed with the aqueous rinsing solution composition based on the initial concentration of the fragrance additive supplied by the manufacturer.

The water used in this aqueous rinsing solution composition of the present invention must have negligible amounts of metal ions and be capable of not leaving any residue or deposit on evaporation from a shower surface. Distilled water or deionized water is preferred as the source of water for dilution of the individual components as well as for the water added as the balance of the composition for an aqueous shower rinsing solution.

Local conditions, such as the degree of water hardness, altitude above sea level, and the composition of typical soils, may be taken into consideration in formulating the aqueous shower rinsing composition. The amount of surfactant and chelating agent may be increased to account for greater water hardness and soils with higher calcium and magnesium levels. At higher altitudes, alcohols having lower vapor pressure can be used.

The aqueous shower rinsing composition is a dilute surfactant solution containing additional additives and is used after showering to prevent the build-up of deposits on shower surfaces. The shower rinsing solution is best sprayed onto the shower surfaces with a pump or pressurized sprayer and, for best results, the shower rinsing solution is applied to shower surfaces before the deposits dry and set. While the rinsing solution does soften and remove dried deposits, its principal benefit is the removal of the deposits that are still wet. The rinsing solution transports these undesirable deposits down wet shower surfaces by gravity and into the shower drain. In subsequent showers, the water and mist from showering enhances the removal of deposits. Thus, the repeated cycles of spray application, drying of shower surfaces and subsequent showering serve to convey deposits down to the shower drain in a semi-continuous fashion. Water rinsing other than the showering itself can be done, but is unnecessary. No scrubbing, wiping, or other mechanical action is necessary, in contrast to conventional cleaning agents which are used to remove deposits only after such deposits have dried.

Previously accumulated build-up of undesirable deposits that have already dried and set can be softened and completely removed, albeit gradually, with continued application of the rinsing solution after each shower. While no wiping or other mechanical action is required to remove such previously dried and set deposits, gentle wiping accelerates the removal of softened deposits that have accumulated over a period of time. This aqueous shower rinsing composition is not a shower cleaner in the conventional sense, but is a rinsing solution for maintaining a clean shower.

Furthermore, in contrast to simply rinsing the shower surfaces with plain tap water or soapy water, both of which leave deposits, the present invention prevents streaking and air-dries spot free. Thus, the aqueous shower rinsing solution provides a product for maintaining showers clean with the minimum of effort. This solution is also effective in maintaining bathtub surfaces and the like clean and spot-free,

EXAMPLE 1

The results of a test comparing different non-ionic surfactants having a range of HLB numbers are presented in Table 1. These results were obtained in a shower in a north Florida locality having hard water. The aqueous composition of the rinsing solutions tested all have the composition of the preferred embodiment described above with the exception that the surfactant is substituted with the test surfactants indicated in Table 1. The names in parentheses in Table 1 are Rhone-Poulenc tradenames of the non-ionic surfactants tested, The results for the tested surfactants in terms of action and surface appearance were graded based on the following criteria:

The residual film was observed on the shower surfaces after applying the test surfactants and then allowing the shower surfaces to dry without rinsing with water, The surface appearance grades are defined as follows:

| | |
|---|---|
| grade A | Very streaky with tracks of build-up on a clear background. |
| grade B | Some streaking with streaks of light build-up on a lightly covered background. |
| grade C | Even distribution of a thick film. |
| grade D | Even distribution of a light film giving a light matte finish to the wall surfaces and the fittings. |
| grade E | Even distribution with a semi-gloss appearance. |

The action of the test surfactants observed during a showering step, subsequent to applying test surfactants and allowing shower surfaces to dry, were graded with action grades defined as follows:

| | |
|---|---|
| grade 1 | The mist of the shower wets only a portion of the surface. This accentuates the tracks and make them stand out. |

-continued

| | |
|---|---|
| grade 2 | The mist of the shower unevenly wets the surface with only partial carrying away of the previous film. |
| grade 3 | The mist of the shower evenly wets the surface exhibiting a glossy look. This wet film moves down the walls and carries film down to the drain. |

TABLE 1

| Surfactant | HLB | Action | Surface Appearance | Comments |
|---|---|---|---|---|
| mixed ethylene glycol ether propoxilated (ANTAROX BL-225) | 12 | grade 3 | grade D | satisfactory |
| sorbitan oleic ester (ALKAMULS 400-DO) | 7.2 | grade 3 | grade D | some residual odor, otherwise satisfactory |
| sorbitan oleic ester (ALKAMULS 400-MO) | 11 | grade 3 | grade D | some residual odor, otherwise satisfactory |
| alkylphenol glycolether (IGEPAL RC-520) | 10 | grade 3 | grade D | satisfactory |
| alkylphenol glycolether (IGEPAL DM 710) | 13 | grade 3 | grade C | marginally satisfactory |
| alkylphenol glycolether (PEGOL 84) | 14 | grade 2 | grade B | unsatisfactory |
| alkylphenol glycolether (IGEPAL CO 970) | 18.2 | grade 3 | grade A | unsatisfactory |
| alkylethoxylates (RHODASURF BC-840) | 15.4 | grade 2 | grade B | unsatisfactory |
| silicone polyalkoxylate block copolymers (ALKASIL NE 58-50) | 12 | grade 3 | grade E | satisfactory (mist irritated nose) |
| 1.35% v/v ethylene glycol ether (ANTAROX BL-225) + 0.15% v/v silicone polyalkoxylate block copolymers (ALKASIL NE 58-50) | 12 | grade 3 | grade E | satisfactory |

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A method of rinsing showers clean, consisting essentially of repeated cycles of the steps of:

wetting surfaces of a shower;

spraying the wet shower surfaces after showering with an aqueous rinsing solution comprising:

0.5% to 3% by volume of a non-ionic surfactant having an HLB of 13 or less;

1 to 8% by volume of an alcohol selected from the group consisting of isopropyl alcohol, ethyl alcohol, n-propyl alcohol, n-butyl alcohol, isobutyl alcohol, and glycerol; and 0.1 to 3% by volume of a chelating agent, wherein said aqueous rinsing solution has a pH in a range of 4 to 8, whereby deposits resulting from showering are removed, without scrubbing or wiping by allowing said aqueous rinsing solution to transport said deposits down the shower surfaces to a drain, said shower surfaces air-drying spot-free and without streaking.

2. The method of rinsing showers clean according to claim 1, wherein said aqueous rinsing solution further comprises distilled or deionized water.

3. The method of rinsing showers clean according to claim 1, wherein said aqueous rinsing solution further comprises about 0.5 to 2% by volume ammonium hydroxide.

4. The method of rinsing showers clean according to claim 1, wherein said aqueous rinsing solution further comprises about 0.5 to 3% morpholine.

5. A method of rinsing showers clean according to claim 1, wherein said chelating agent is selected from the group consisting of ethylene diamine tetraacetic acid, diammonium ethylenediamine triacetate, hydroxyethyl-ethylenediamine triacetic acid, diethylenetriamine-pentaacetic acid, and nitrilotriacetic acid.

6. The method of rinsing showers clean according to claim 1, wherein the non-ionic surfactant has an HLB of 12.5 or less.

7. The method of rinsing showers clean according to claim 1, wherein the non-ionic surfactant has an HLB of 12 or less.

8. The method of rinsing showers clean according to claim 1, wherein said deposits to be removed are dried on said shower surfaces.

9. The method of rinsing showers clean according to claim 1, wherein said aqueous rinsing solution has a pH in a range of about 5 to 7.

10. The method of rinsing showers clean according to claim 1, wherein said aqueous rinsing solution has a pH of about 5.

11. A method of rinsing showers clean, consisting essentially of repeated cycles of the steps of:

wetting surfaces of a shower;

spraying the wet shower surfaces after showering with an aqueous rinsing solution consisting essentially of:

0.5 to 3% by volume of a non-ionic surfactant having an HLB of 13 or less;

1 to 8% by volume of an alcohol selected from the group consisting of isopropyl alcohol, ethyl alcohol, n-propyl, n-butyl alcohol, isobutyl alcohol, and glycerol;

0.1 to 3% by volume of a chelating agent, wherein said aqueous solution has a pH in a range of 4 to 8;

water;

optionally, a base for adjusting the pH selected from the group consisting of ammonium hydroxide and morpholine; and optionally, a fragrance additive, whereby deposits resulting from showering are removed without scrubbing or wiping by allowing said aqueous rinsing solution to transport said deposits down shower surfaces to a drain, said shower surface air-drying spot-free and without streaking.

12. The method of rinsing showers clean according to claim 11, wherein the non-ionic surfactant has an HLB of 12.5 or less.

13. The method of rinsing showers clean according to claim 11, wherein the non-ionic surfactant has an HLB of 12 or less.

14. The method of rinsing showers clean according to claim 11, wherein said deposits to be removed are dried on said surfaces.

15. The method rinsing showers clean according to claim 11, wherein said aqueous rinsing solution has a pH in a range of about 5 to 7.

16. The method of rinsing showers clean according to claim 11, wherein said aqueous rinsing solution has a pH of about 5.

17. A method of rinsing showers clean according to claim 11, wherein said chelating agent is selected from the group consisting of ethylene diamine tetraacetic acid, diammonium ethylenediamine triacetic acid, diethylenetriamine-pentaacetic acid, and nitriloacetic acid.

18. The method of rinsing showers according to claim 11, wherein said base is about 0.5 to 2% by ammonium hydroxide or about 0.5% to 3% by volume morpholine.

19. The method of rinsing showers according to claim 11, wherein said water is distilled or deionized water.

20. The method of rinsing showers according to claim 11, wherein said fragrance additive is 0.0005% to 0.008% by volume.

* * * * *

UNITED STATES PATENT AND TRADEMARK OFFICE

CERTIFICATE OF CORRECTION

PATENT NO. : 5,587,022

DATED : December 24, 1996

INVENTOR(S) : Robert H. Black

It is certified that error appears in the above-identified patent and that said Letters Patent is hereby corrected as shown below:

On the title page, item [60] Related U.S. Application Data, delete "abandoned," and insert therefor --now U.S. Patent 5,536,452--.

Column 1, line 5, delete "abandoned" and insert therefor --U.S. Patent 5,536,452--.

Column 6, line 63, after "n-propyl" insert --alcohol--.

Column 8, line (claim 18), line 11, after "2% by" insert --volume--.

Signed and Sealed this

Twenty-seventh Day of May, 1997

*Attest:*

Bruce Lehman

BRUCE LEHMAN

*Attesting Officer*

*Commissioner of Patents and Trademarks*